US009433309B2

(12) United States Patent
Cheng et al.

(10) Patent No.: US 9,433,309 B2
(45) Date of Patent: Sep. 6, 2016

(54) PILLOW

(71) Applicants: Tech Cheng, Germantown, MD (US); Neale Castillo, Gaithersburg, MD (US)

(72) Inventors: Tech Cheng, Germantown, MD (US); Neale Castillo, Gaithersburg, MD (US)

( * ) Notice: Subject to any disclaimer, the term of this patent is extended or adjusted under 35 U.S.C. 154(b) by 0 days.

(21) Appl. No.: 14/454,855

(22) Filed: Aug. 8, 2014

(65) Prior Publication Data

US 2015/0040322 A1 Feb. 12, 2015

Related U.S. Application Data

(60) Provisional application No. 61/863,961, filed on Aug. 9, 2013.

(51) Int. Cl.
*A47G 9/10* (2006.01)

(52) U.S. Cl.
CPC ..... *A47G 9/1054* (2013.01); *A47G 9/109* (2013.01); *A47G 2009/1018* (2013.01)

(58) Field of Classification Search
CPC ..... A47G 9/10
USPC ..... 5/630, 636, 638
See application file for complete search history.

(56) References Cited

U.S. PATENT DOCUMENTS

| | | | | |
|---|---|---|---|---|
| 3,124,812 | A * | 3/1964 | Milton et al. | 5/638 |
| 4,752,064 | A | 6/1988 | Voss | |
| 4,788,728 | A | 12/1988 | Lake | |
| D337,914 | S * | 8/1993 | McDonald | D6/601 |
| 5,269,035 | A * | 12/1993 | Hartunian | 5/638 |
| 5,426,798 | A | 6/1995 | Guarino | |
| 5,644,809 | A | 7/1997 | Olson | |
| 5,960,494 | A * | 10/1999 | Gilliland | A61G 13/12 5/638 |
| 6,128,797 | A | 10/2000 | Shaffer | |
| 6,230,350 | B1 | 5/2001 | Goldstein | |
| D456,516 | S * | 4/2002 | Cheshaek et al. | D24/183 |
| 6,637,058 | B1 | 10/2003 | Lamb | |
| 6,745,418 | B1 | 6/2004 | Turner, Jr. | |
| D625,420 | S * | 10/2010 | Sharps et al. | D24/184 |
| 8,006,335 | B1 | 8/2011 | Andermann | |
| 2007/0006382 | A1 * | 1/2007 | Guez | A47G 9/10 5/638 |
| 2008/0047070 | A1 * | 2/2008 | Forness Wilson et al. | 5/636 |

FOREIGN PATENT DOCUMENTS

| | | | |
|---|---|---|---|
| CN | 2922660 | Y | 7/2007 |
| CN | 201205148 | Y | 3/2009 |
| CN | 102273872 | A | 12/2011 |
| KR | 10-0584040 | | 9/2005 |

OTHER PUBLICATIONS

English language abstract of CN 102273872 A.
Machine Translation of CN 2922660 Y.
Machine Translation of CN 201205148 Y.
Machine Translation of KR 10-0584040.
Web page of PODillow(R) from www.podillow.com, printed on Jun. 4, 2013.
Web page of Pron-Pillo from www.amazon.com, printed on Jun. 4, 2013.

(Continued)

*Primary Examiner* — Fredrick Conley
(74) *Attorney, Agent, or Firm* — Sonapat LLC

(57) ABSTRACT

The disclosure relates to pillows that allow the user to rest comfortably in a variety of different positions.

8 Claims, 7 Drawing Sheets

(56) References Cited

OTHER PUBLICATIONS

Web page of PillowMed Orthopedic Pillow from http://pillowmed.com, printed on May 5, 2013.

Web page for Sleepwell USA Key Hole Pillow, containing comments dated Dec. 2010-Mar. 2013.

* cited by examiner

PILLOW

This application claims the benefit of priority to U.S. Provisional Application No. 61/863,961, filed on Aug. 9, 2013, the entire contents of which are incorporated by reference herein.

FIELD OF THE DISCLOSURE

The present disclosure relates to pillows. The pillows allow the user to rest comfortably in a variety of different positions.

SUMMARY

One embodiment of the invention is a pillow, comprising:

a first surface and an opposing second surface separated by the pillow depth;

a contour provided on at least one of the first and second surfaces, wherein the contour comprises a valley between two peaks;

a recess, positioned in the valley, that extends into the pillow depth; and at least one ventilation channel that extends from the recess to a surface of the pillow.

Another embodiment of the invention is a pillow, comprising:

a first surface and an opposing second surface separated by the pillow depth;

a contour provided on at least one of the first and second surfaces, wherein the contour comprises a valley between two peaks;

a recess, positioned in the valley, that extends through the pillow depth; and at least one trench disposed within at least one contoured surface, wherein the trench extends from the recess to the periphery of the pillow.

The pillows allow the user to rest comfortably in a variety of different positions, such as on their back, on their left or right side, or on their stomach. While resting on their stomach, the user may comfortably lay face down without the need to twist the neck and turn the head to the left or right. The pillows can be used in a variety of settings, such as while sleeping, while tanning (e.g. sunbathing) or receiving a massage, or during physical therapy or a medical procedure such as surgery.

Additional embodiments and features are included in the detailed description that follows, and will be readily apparent to those skilled in the art from the description or recognized by practicing the embodiments as described in the description, drawings and claims.

BRIEF DESCRIPTION OF THE DRAWINGS

The accompanying drawings constitute a part of this specification. The drawings serve to provide a further understanding of certain exemplary embodiments of the invention. The invention is not limited to embodiments illustrated in the drawings.

In FIG. 2A the recess extends through the entire depth of the pillow, as illustrated with dashed lines. In FIG. 2B the recess extends through only a portion of the depth of the pillow.

DETAILED DESCRIPTION

Figure 1:
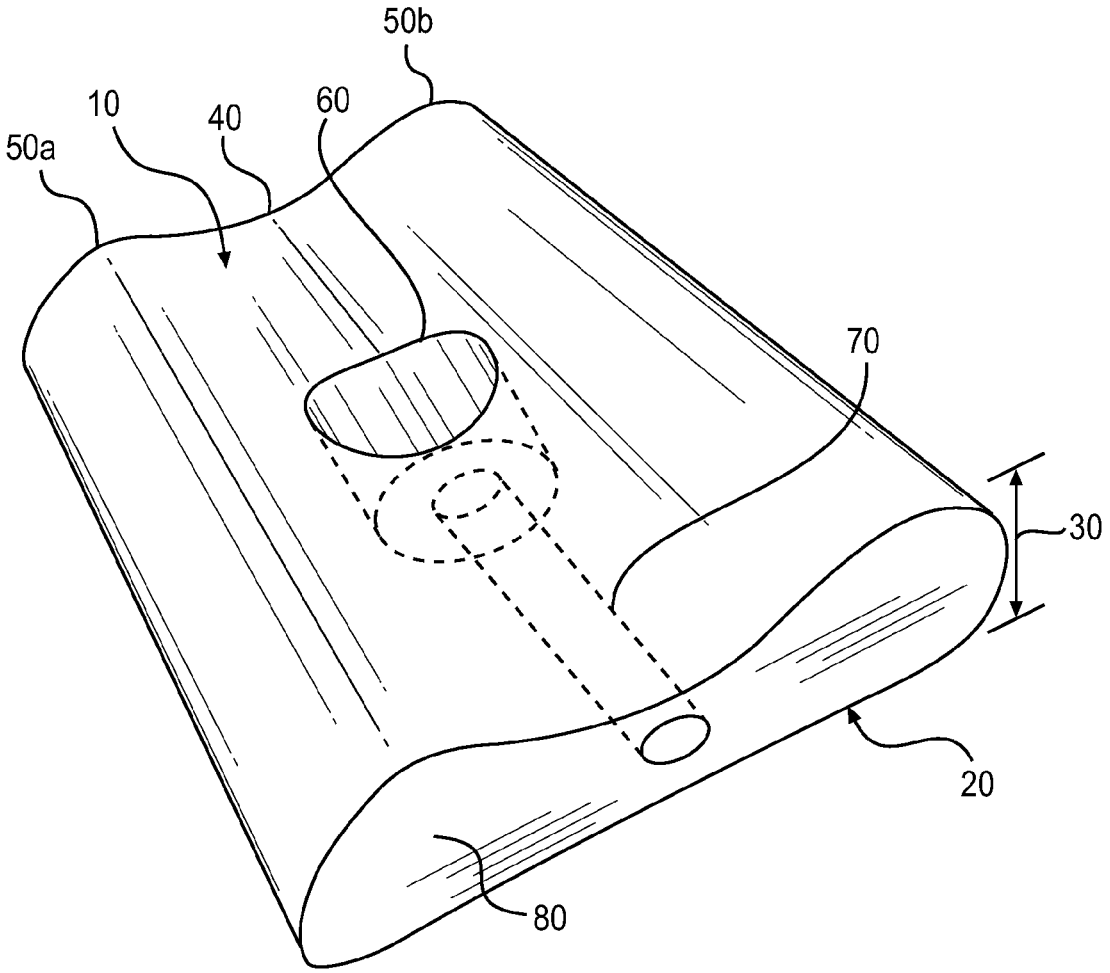
FIG. 1 is a perspective view of one embodiment of the invention that includes a ventilation channel.

Various embodiments of the invention will now be explained in greater detail. It is to be understood that both the foregoing general description and the following detailed description are exemplary and explanatory only, and are not restrictive of the invention as claimed. Any discussion of certain embodiments or features, including those depicted in the drawings, serve to illustrate certain exemplary aspects of the invention. The invention is not limited to the embodiments specifically discussed herein or illustrated in the drawings.

One embodiment of the invention is a pillow, comprising:

a first surface and an opposing second surface separated by the pillow depth;

a contour provided on at least one of the first and second surfaces, wherein the contour comprises a valley between two peaks;

a recess, positioned in the valley, that extends into the pillow depth; and at least one ventilation channel that extends from the recess to a surface of the pillow.

FIG. 1 illustrates one example of such a pillow. The pillow comprises a first surface 10 and an opposing second surface 20 separated by the pillow depth 30. A contour is provided on first surface 10, wherein the contour comprises a valley 40 between two peaks 50*a* and 50*b*. The pillow includes a recess 60, positioned in the valley 40, that extends from the first surface into the pillow depth, and a ventilation channel 70 that extends from the recess 60 to a surface 80 of the pillow.

Figure 4A:
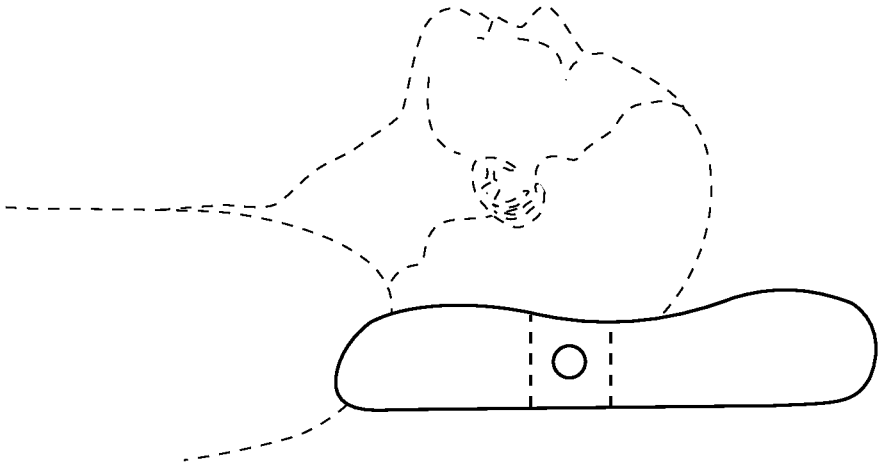
FIGS. 4A, 4B and 4C are side views of embodiments of the invention, also illustrating a user resting on the pillow on their back (FIG. 4A), right side (FIG. 4B) and stomach while lying face down (FIG. 4C), respectively.
Figure 4B:
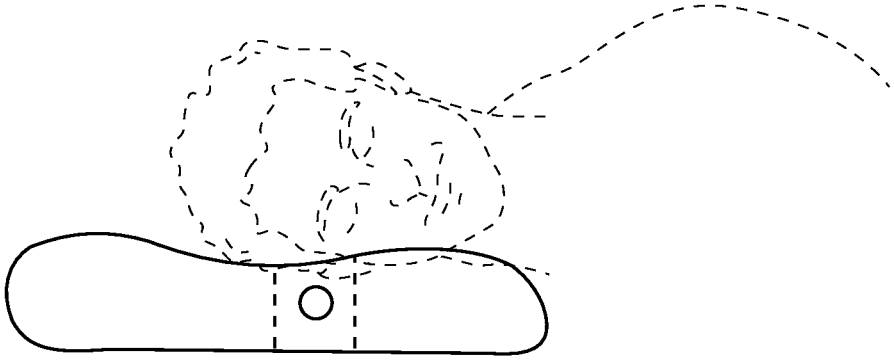
Figure 4C:
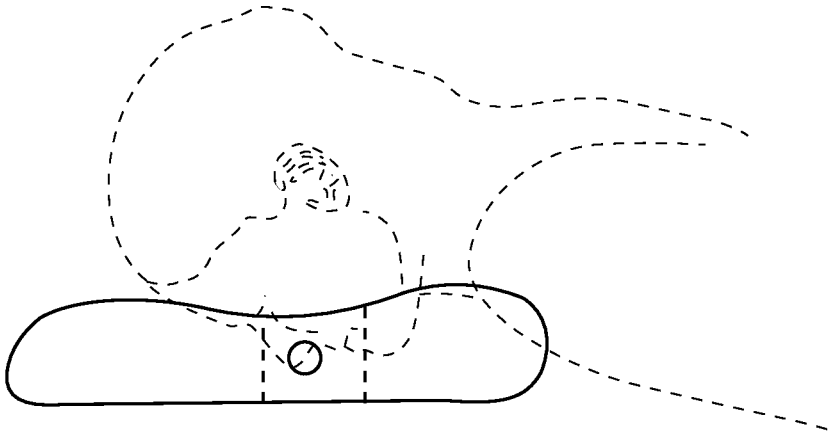

FIGS. 4A, 4B and 4C are side views of embodiments of the invention, also illustrating a user resting on the pillow on their back (FIG. 4A), right side (FIG. 4B) and stomach while lying face down (FIG. 4C), respectively.

Figure 3:
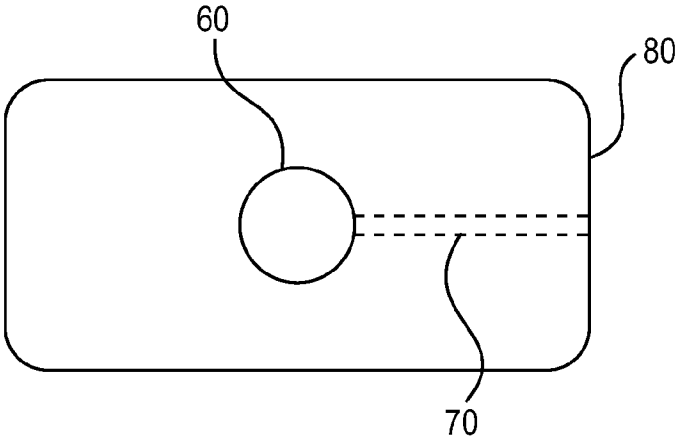
FIG. 3 is a top view of one embodiment of the invention.

The pillow of this embodiment that includes a ventilation channel, or of the embodiment described later herein that includes a trench, may be of any appropriate shape or size. FIG. 1, as well as the top view in FIG. 3, illustrates a pillow of generally rectangular shape. The pillow may alternatively have any other shape, such as a square, circular, oval, or triangular shape. The pillow may be sized to extend, for example, from approximately the neck or top of the shoulders of the user to just above the top of the head, as illustrated in FIGS. 4A, 4B and 4C. In one embodiment, the pillow is sized such that it does not extend below the shoulders of the user. In such an embodiment, the pillow is sized to provide only support to the head and neck of the user, or support to the head and neck and shoulders of the user, but not to the chest of the user.

A contour is provided on at least one of the first and second surfaces of the pillows described herein and comprises a valley formed between two peaks. The pillow depth 30 may vary across the pillow, depending on the nature of the contouring on the first and/or second surfaces. The valley is configured to receive the head of a user resting on the pillow. The valley portion of the contour may take any appropriate form. For example, the valley portion of the contour may be flat, or alternatively may be curved, or may comprise both a flat portion and a curved portion. In the embodiment of FIG. 1, for instance, the valley has a concave shape. The transition in the contour from the bottom of the valley to the peaks may be anywhere along a continuum from gradual to steep, comprising any appropriate slope from the bottom of the valley to either peak. In the embodiment of FIG. 1, for instance, the contour comprises a gradual slope from the bottom of the concave valley 40 to the peaks 50*a* and 50*b* on either side.

The peaks, which together form the valley therebetween, represent points of maximum elevation of the contour located on each side of the valley. Each peak has a positive, non-zero height measured from the bottom of the valley. When the bottom of the valley is flat, the peak height may be measured in a direction perpendicular to the plane of the bottom of the valley. When the bottom of the valley is curved, such as in a concave shape, the peak height may be measured in a direction perpendicular to the tangent of the bottom of the concave curve.

Each contour peak may be of any appropriate height, such as a height of from 0.25 inches to 2.0 inches measured from the bottom of the valley, including 0.25, 0.5, 0.75, 1.0, 1.25, 1.5, 1.75 and 2.0 inches in height, measured from the bottom of the valley. In addition, the two peaks may be of equal height or of unequal height relative to each other. For example, one peak may have 25%, 50% or 75% the height of the other peak, with their respective heights being measured from the bottom of the valley. A contour having two peaks of different height provides the user with the option to choose one orientation of the pillow over another, depending on the user's preferences at the time. For example, the user may wish to rest with a lower peak in the contour closer to the shoulders and a higher peak in the contour closer to the top of the head, as illustrated in FIGS. 4A and 4B, or vice versa.

Figure 2A:
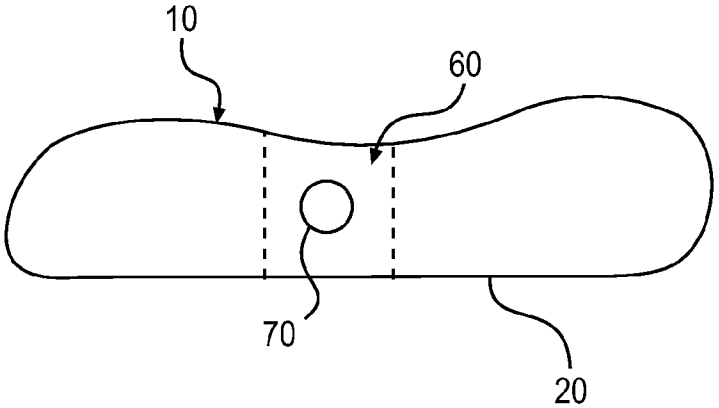
FIGS. 2A and 2B are side views of embodiments of the invention.
Figure 2B:
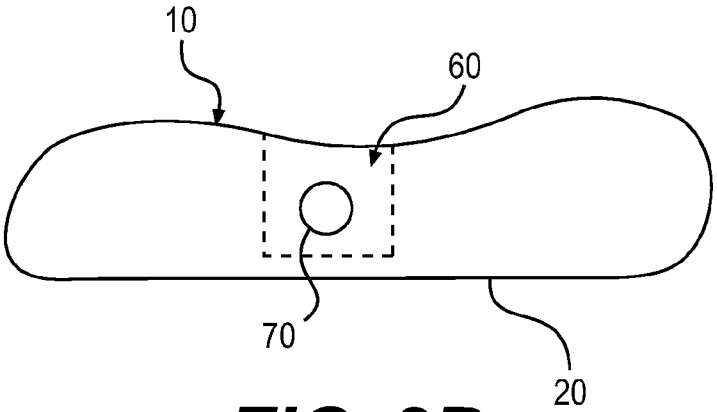

Each peak may be located any appropriate lateral distance from the bottom of the valley. In the embodiments shown in FIGS. 4A, 4B and 4C, at least one peak is positioned such that the user may place their neck on the peak while their head rests at the bottom of the valley. Each peak may also be located at any appropriate location along the first or second surfaces. For example, one or more peaks may be located at some point between an edge of the surface and the bottom of the valley, such as shown in FIGS. 2A and 2B. FIGS. 2A and 2B illustrate a gradual slope upwards to each peak from the bottom of the valley, then a gradual slope downwards on the other side of each peak. Alternatively, one or more peaks could be located at an edge of the surface such that the contour includes a slope upwards to the peak from the bottom of the valley, wherein the pillow surface terminates at that peak.

The contour may extend completely across the pillow width from one side of the pillow to the other side of the pillow or may extend across only a portion of the width of the pillow. For instance, FIG. 1 illustrates a pillow having two sides (side 80 being numbered and an opposing side parallel to side 80), with valley 40 and peaks 50*a* and 50*b* extending from one side to the other. As also shown in FIG. 1, the valley and peaks proceed from one side of the pillow to the other in a direction perpendicular to the sides of the pillow.

In some embodiments, the contour is provided on only one of the first and second surfaces, while in others the contour is provided on both the first and second surfaces. When a contour is provided on both surfaces, the contour on the first surface may differ from the contour on the second surface. For example, 1) the contour on the first surface may comprise peaks of equal height while the contour on the second surface comprises one peak having a height different from that of the second peak, or, 2) the first surface may comprise peaks of equal height and the second surface may also comprise peaks of equal height, but the peaks of the second surface have a different height than the peaks of the first surface, or, 3) the first surface may comprise peaks of unequal height and the second surface may also comprise peaks of unequal height, with all four peaks having a different height relative to each other, with the height of each peak being measured from the bottom of its respective valley. The contours of the first and second surfaces may also differ in any other respects, such as in the slopes of the transition from the bottom of the valley to the peaks. Any variation between the two contours provides the user with the option to choose one orientation of the pillow over another, depending on the user's preferences at the time.

The pillows comprise a recess (such as recess 60 in FIGS. 1 and 6), positioned in the valley, that extends from the surface into the pillow depth (such as shown in dotted lines in FIGS. 1, 2A and 2B). The user of the pillow may place his or her face in the recess when lying, for example, face down. The recess provides a convenient location in which the user may place their face when resting on their stomach, without needing to twist the neck and turn the head to the left or right.

The user may also choose to rest on their stomach or left or right side, with the side of their head (possibly the ear, for example) placed in the recess. The user may also choose to rest on their back, with the back of their head placed in the recess. Alternatively, the user may rest in any configuration with their head placed to the left or right of the recess such that their head simply rests in the valley of the contour but not in the recess itself.

The recess may be of any appropriate shape, such as circular, oval, square, or rectangular, or may be formed in the shape of a human face or some shape approximating the shape of a human face, or may be in any way configured to receive a human face or head. The recess may be of any appropriate size, and may be sized to allow the user to place their nose, or both their nose and mouth, in the recess. In some embodiments, the recess is of a circular shape having a diameter, for example, of from 2.0 to 6.0 inches.

In some embodiments, the recess extends through the entire depth of the pillow, from the first surface to the second surface, as shown in FIG. 2A. This embodiment offers the user the convenience of resting on either the first surface or the second surface, each surface having the recess available for use. In other embodiments that include a ventilation channel, the recess extends through only a portion of the depth of the pillow as shown in FIG. 2B.

In some embodiments, the pillow comprises at least one ventilation channel (such as ventilation channel 70 in FIG. 1) that extends from the recess to a surface of the pillow. The ventilation channel allows for the passage of air from the recess to a surface of the pillow and vice versa. Thus, a user of the pillow may rest on their stomach, place their face in recess, and comfortably breathe with the passage of air from the recess through the ventilation channel. Thus, the recess may be said to be in fluid communication with the ventilation channel and vice versa.

The ventilation channel may be of any appropriate cross-sectional shape, such as circular, oval, square, triangular or rectangular. The ventilation channel may also be of any appropriate size, such as from 0.5 inches to 2.0 inches in diameter in the case of a circular cross-section. The ventilation channel is positioned within the depth of the pillow (as opposed to being cut into the surface), having its cross-sectional dimensions and perimeter defined only by the surrounding pillow body. The point of intersection of the recess and ventilation channel may be selected, for example, such that the intersection would be located at or below the mouth and/or nose of the user when resting face down. That point of intersection may be selected, for example, taking into account the expected weight on the pillow during use and the deformation properties of the pillow.

The ventilation channel may extend from the recess to any appropriate surface of the pillow. In one embodiment, the pillow comprises side surfaces or front and back surfaces on its periphery in addition to the first and second surfaces described above. In one embodiment, the ventilation channel extends from the recess to a side surface of the pillow, such as side surface 80 shown in FIGS. 1 and 3. In another embodiment, the ventilation channel may extend to the first or second surface of the pillow. For example, the ventilation channel may extend from the recess up to any location on first surface 10 in FIG. 1 when the user is resting on that surface of the pillow.

Any number of ventilation channels may be included in the pillow. In one embodiment, the pillow comprises only one ventilation channel. In another embodiment, the pillow comprises two or more ventilation channels. The two or more ventilation channels may be the same or different in shape or size, may intersect with the recess at different points, and may extend to the same or different surfaces of the pillow.

Figure 5:
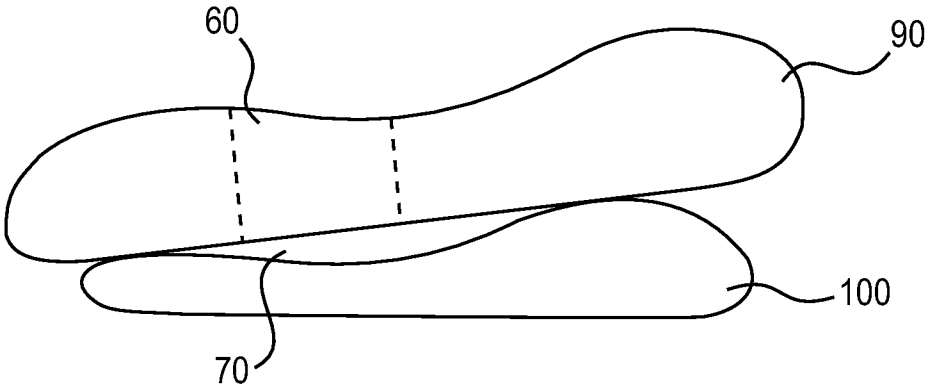
FIG. 5 is a side view of another embodiment of the invention.

The pillows described herein may be of single piece construction or may be constructed of two or more pieces. When constructed of two or more pieces, the pillow may comprise a first piece comprising the first surface and a second piece comprising the second surface. FIG. 5 illustrates such an embodiment with first piece 90 (comprising the top contoured first surface) and second piece 100 (comprising the bottom flat second surface). The recess 60 may extend through the entire depth of the first and second pieces. Alternatively as shown in FIG. 5, the recess may extend through the entire depth of the first piece but not extend through the entire depth of the second piece, or through the second piece at all. FIG. 5 also illustrates that the pillow may comprise a space between the first and second pieces, where the space itself serves as the ventilation channel 70. The first and second pieces may be permanently or non-permanently joined in any appropriate manner, such as through the use of an adhesive or through permanent stitching or non-permanent attachment such as with snap-buttons, zippers, or Velcro.

Another embodiment of the invention is a pillow, comprising:

a first surface and an opposing second surface separated by the pillow depth;

a contour provided on at least one of the first and second surfaces, wherein the contour comprises a valley between two peaks;

a recess, positioned in the valley, that extends through the pillow depth; and at least one trench disposed within at least one contoured surface, wherein the trench extends from the recess to the periphery of the pillow.

The recess in this embodiment extends through the entire pillow depth from the first surface to the second surface. The shape and size of the pillow, the features of the first and second surfaces, the features of the valley and peaks, and other properties of the recess in this embodiment can be as described above for previously-discussed embodiments.

Figure 6:
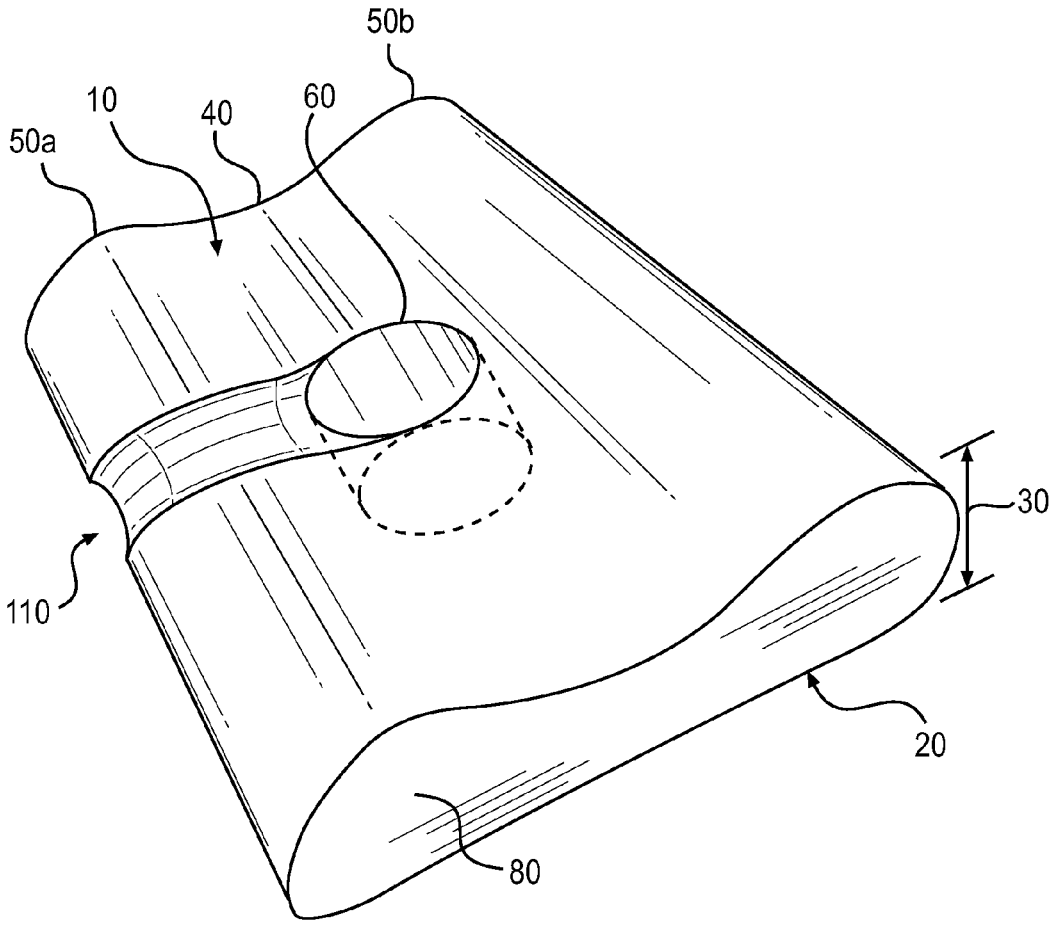
FIG. 6 is a perspective view of one embodiment of the invention that includes a trench.

FIG. 6 illustrates one example of this pillow. The pillow comprises a first surface 10 and an opposing second surface 20 separated by the pillow depth 30. A contour is provided on first surface 10, wherein the contour comprises a valley 40 between two peaks 50*a* and 50*b*. The pillow includes a recess 60, positioned in the valley 40, that extends from the first surface through the pillow depth, and a trench 110 disposed within contoured surface 10, wherein the trench extends from the recess 60 to the periphery of the pillow.

The trench is a depression in the contoured surface that extends from the recess to the periphery of the pillow. In FIG. 6, the trench extends to the front surface of the pillow. The trench could alternatively extend to the back surface or side surfaces on the periphery of the pillow. The trench has a depth less than the depth of the portion of the pillow in which it is disposed, i.e. the trench has a floor formed by the pillow body. In FIG. 6, the trench 110 is shown as having sides and a floor formed by the pillow body. The trench may be of any other appropriate cross-sectional shape and may include rounded corners or edges. The trench may also have any appropriate width or depth, such as a width of from 6.0 to 8.0 inches and/or a depth of from 1.0 to 4.0 inches.

In some embodiments, the at least one trench extends from the recess through at least one peak to the periphery of the pillow. In FIG. 6, for example, the peak 50*a* extends from one side of the pillow to another, and the trench 110 extends through the peak in a direction perpendicular to the peak.

The pillow may contain one trench or two or more trenches. When the pillow contains one trench, the user may choose to rest on their back, with the back of the head placed in the recess and the back of the neck resting in the trench. The user may alternatively choose to flip the pillow upside-down with the trench being in the portion of the pillow above the head, resting on their stomach with their face placed in the recess. In that arrangement, the trench at the bottom of the pillow may serve to provide ventilation.

Figure 8:
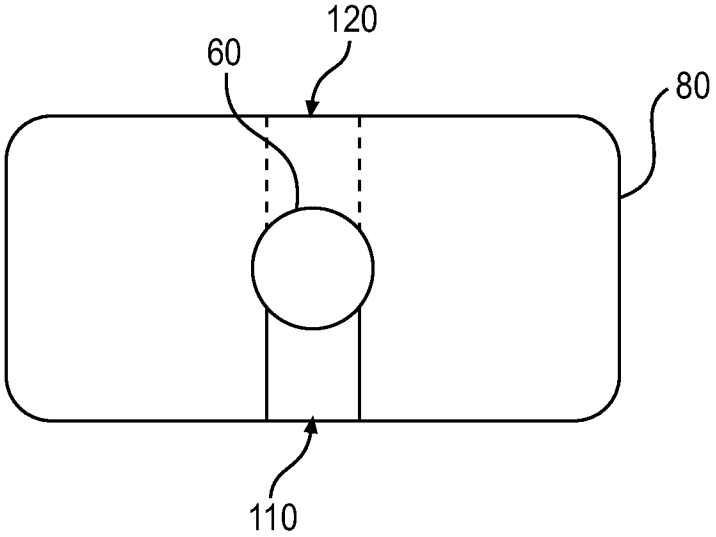
FIG. 8 is a top view of the embodiment illustrated in FIG. 7.
Figure 7:
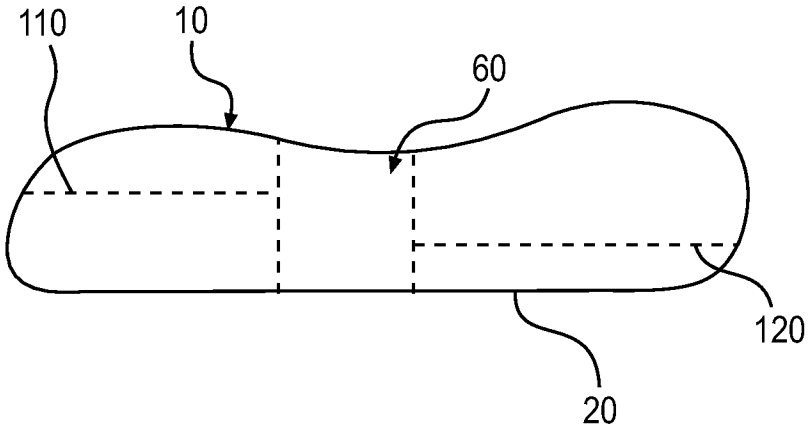
FIG. 7 is a side view of an embodiment of the invention.

When the pillow comprises two or more trenches, the trenches may be disposed on the first pillow surface, the second pillow surface, or on both surfaces. In one embodiment, the pillow comprises a first trench disposed within the first surface, and a second trench disposed within the second surface, wherein the first and second trenches extend from the recess to the periphery of the pillow. FIGS. 7 and 8 illustrate a side view and top view, respectively, of such an embodiment. FIG. 7 illustrates trench 110 (the floor illustrated by the dotted line) disposed within contoured surface 10, and trench 120 disposed within the opposing surface of the pillow. In such an embodiment, the first and second trenches may be parallel and along the same axis as illustrated in the top view of the pillow shown in FIG. 8. As also shown in FIGS. 7 and 8, the two trenches extend from opposing sides of the recess to opposing peripheral surfaces (i.e. front and back) of the pillow. In such an embodiment, the user may rest on their back with the back of their head placed in the recess and back of the neck placed in the trench, or the user may rest on their stomach with their face placed in the recess, where the trench on the opposing bottom surface of the pillow serves to provide ventilation.

The pillows described herein may be constructed of any appropriate material. For example, the pillows may be constructed as one or more solid pieces of deformable or non-deformable material such as foam, including memory foam. Deformable materials such as foam may be selected to have any desired degree of elasticity, resiliency, and deformation or cushioning properties. Such properties can be varied, for example, by varying the type of material used in the pillow or the density of such material. The pillows could be made, for example, from one piece of foam as a starting material. The starting material may be cut or ablated in a pattern to produce the desired contouring, and may be cut, ablated, or drilled to create the recess and one or more ventilation channels or trenches. The pillow could also be made by a molding process, such as by injection molding.

The pillow may alternatively be constructed to include a lining that contains filler material, such as a gel, beans, pellets, cotton, feathers or memory foam beads. The lining may be of any appropriate material, such as fabric or flexible polymer. The pillow could also be inflatable via a valve, such that it adopts its intended structure upon inflation and can be deflated for convenient transport in a smaller size. Regardless of how they are constructed, the pillows may be used with or without a pillow cover that can be specially designed for the pillows.

In one embodiment when the pillows comprise two or more pieces, at least one of the first piece and second piece comprises a deformable material such as foam. In some embodiments, the first piece and second piece each comprise foam. The foam used in the first and second pieces may be the same or different. In one embodiment, the foam of the first piece is different from the foam of the second piece, such as being different in foam density.

The following numbered clauses provide further exemplary embodiments:

Clause 1. A pillow, comprising:

a first surface and an opposing second surface separated by the pillow depth;

a contour provided on at least one of the first and second surfaces, wherein the contour comprises a valley between two peaks;

a recess, positioned in the valley, that extends into the pillow depth; and at least one ventilation channel that extends from the recess to a surface of the pillow.

Clause 2. A pillow according to clause 1, wherein the contour is provided on only one of the first and second surfaces.

Clause 3. A pillow according to clause 1, wherein the contour is provided on both the first and second surfaces.

Clause 4. A pillow according to clause 3, wherein the contour provided on the first surface is different from the contour provided on the second surface.

Clause 5. A pillow according to any one of clauses 1-4, wherein the two peaks are of equal height.

Clause 6. A pillow according to any one of clauses 1-4, wherein the two peaks are of unequal height.

Clause 7. A pillow according to any one of clauses 1-6, wherein the recess extends through the entire depth of the pillow.

Clause 8. A pillow according to any one of clauses 1-6, wherein the recess extends through only a portion of the depth of the pillow.

Clause 9. A pillow according to any one of clauses 1-8, which comprises only one ventilation channel.

Clause 10. A pillow according to any one of clauses 1-8, which comprises two or more ventilation channels.

Clause 11. A pillow according to any one of clauses 1-10, which comprises a side surface, and wherein the ventilation channel extends from the recess to the side surface.

Clause 12. A pillow according to any one of clauses 1-11, wherein the pillow comprises foam.

Clause 13. A pillow according to any one of clauses 1-12, which is of single piece construction.

Clause 14. A pillow according to any one of clauses 1-12, which is constructed of two or more pieces.

Clause 15. A pillow according to clause 14, which comprises a first piece comprising the first surface and a second piece comprising the second surface.

Clause 16. A pillow according to clause 15, wherein the recess extends through the entire depth of the first and second pieces.

Clause 17. A pillow according to clause 15, wherein the recess extends through the entire depth of the first piece but does not extend through the entire depth of the second piece.

Clause 18. A pillow according to any one of clauses 15-17, which comprises a space between the first and second pieces, wherein the space forms the ventilation channel.

Clause 19. A pillow according to any one of clauses 15-18, wherein at least one of the first piece and second piece comprises foam.

Clause 20. A pillow according to any one of clauses 15-18, wherein the first piece and second piece each comprise foam, wherein the foam of the first piece is different from the foam of the second piece.

Clause 21. A pillow, comprising:

a first surface and an opposing second surface separated by the pillow depth;

a contour provided on at least one of the first and second surfaces, wherein the contour comprises a valley between two peaks;

a recess, positioned in the valley, that extends through the pillow depth; and at least one trench disposed within at least one contoured surface, wherein the trench extends from the recess to the periphery of the pillow.

Clause 22. A pillow according to clause 21, wherein the at least one trench extends from the recess through at least one peak to the periphery of the pillow.

Clause 23. A pillow according to clause 22, wherein the peak extends from one side of the pillow to another, and the trench extends in a direction perpendicular to the peak.

Clause 24. A pillow according to any one of clauses 21-23, wherein the pillow comprises two or more trenches.

Clause 25. A pillow according to clause 24, which comprises:

a first trench disposed within the first surface, and a second trench disposed within the second surface, wherein the first and second trenches extend from the recess to the periphery of the pillow.

Clause 26. A pillow according to clause 25, wherein the first and second trenches are parallel.

Clause 27. A pillow according to clause 26, wherein the first and second trenches extend from opposing sides of the recess to opposing peripheral surfaces of the pillow.

Clause 28. A pillow according to any one of clauses 21-27, wherein the contour is provided on only one of the first and second surfaces.

Clause 29. A pillow according to any one of clauses 21-27, wherein the contour is provided on both the first and second surfaces.

Clause 30. A pillow according to any one of clauses 21-29, wherein the pillow comprises foam.

While the invention has been described in detail with respect to certain embodiments, the invention is not limited to those embodiments. It should be understood that modifications and combinations may be made to the illustrated embodiments and other disclosed features to form yet additional embodiments within the scope of the invention.

We claim:

1. A pillow, comprising:

a first surface and an opposing second surface separated by the pillow depth;

a contour provided on at least one of the first and second surfaces, wherein the contour comprises a valley between two peaks, and wherein the valley and peaks extend across the pillow width from one side of the pillow to another;

a recess, positioned in the valley, that extends through the pillow depth;

at least one trench disposed within the at least one contoured surface, wherein the trench extends from the recess through at least one peak to the periphery of the pillow and has a depth less than the depth of the portion of the pillow in which it is disposed, thereby having a floor formed by the pillow body; and at least one trench disposed within the opposing surface, wherein the trench extends from the recess to the periphery of the pillow and has a depth less than the depth of the portion of the pillow in which it is disposed, thereby having a floor formed by the pillow body.

2. A pillow according to claim 1, wherein the trench disposed within the at least one contoured surface and the trench disposed within the opposing surface are parallel to each other and extend from opposing sides of the recess to opposing peripheral surfaces of the pillow.

3. A pillow according to claim 2, wherein the two peaks in the contour are of unequal height relative to each other.

4. A pillow according to claim 2, wherein at least one peak is located between an edge of the surface and the bottom of the contour valley, thereby providing a downward slope from the peak to the valley and from the peak to the edge of the surface.

5. A pillow according to claim 1, wherein the trench disposed within the at least one contoured surface extends in a direction perpendicular to the valley and peaks that extend across the pillow width.

6. A pillow according to claim 1, which is of single piece construction.

7. A pillow according to claim 6, wherein the pillow is made of one piece of foam.

8. A pillow according to claim 1, wherein the pillow is square or rectangular in shape, and wherein the valley and peaks extend across the pillow width from one side of the pillow to another in a direction perpendicular to those sides of the pillow.

* * * * *